United States Patent [19]

L'hermite

[11] Patent Number: 4,999,540

[45] Date of Patent: Mar. 12, 1991

[54] PHOTOMULTIPLIER TUBE COMPRISING A LARGE FIRST DYNODE AND A STACKABLE-DYNODE MULTIPLIER

[75] Inventor: Pierre L'hermite, Brive, France

[73] Assignee: U.S. Philips Corp., New York, N.Y.

[21] Appl. No.: 456,993

[22] Filed: Dec. 26, 1989

[30] Foreign Application Priority Data

Jan. 17, 1989 [FR] France ..... 89 00486

[51] Int. Cl.[5] ..... H01J 43/18

[52] U.S. Cl. ..... 313/533; 313/103 R; 313/536; 313/103 CM; 313/104; 313/105 CM; 313/528; 313/532; 313/534

[58] Field of Search ..... 313/103 R, 103 CM, 104, 313/105 R, 105 CM, 532, 533, 534, 536, 528; 250/206, 207

[56] References Cited

U.S. PATENT DOCUMENTS 3,119,037 1/1964 Stanley ..... 313/105 X
4,184,098 1/1980 Morales ..... 313/105 R X
4,623,785 11/1986 L'hermite ..... 313/532 X
4,649,314 3/1987 Eschard ..... 313/103 CM

FOREIGN PATENT DOCUMENTS 0345888 12/1989 France ..... 313/532
2090049 6/1982 United Kingdom ..... 313/105 R

*Primary Examiner*—Donald J. Yusko
*Assistant Examiner*—Ashok Patel
*Attorney, Agent, or Firm*—William L. Botjer

[57] ABSTRACT

A photomultiplier tube (10) for the use in high collecting power is described having a photocathode (20), a first dynode (30) and a stackable-dynode multiplier device (40). According to the invention, the first dynode (30) is constituted by a sheet which extends parallel to the photocathode (20) and is provided with a feedthrough aperture (31), an extracting grid (32) being arranged between the photocathode (20) and the sheet, and the stackable-dynode multiplier device (40) is positioned opposite the aperture (30) in such a manner as to collect the secondary electrons (50) emitted by the first dynode (30) and passing through the feedthrough aperture (31).

2 Claims, 1 Drawing Sheet

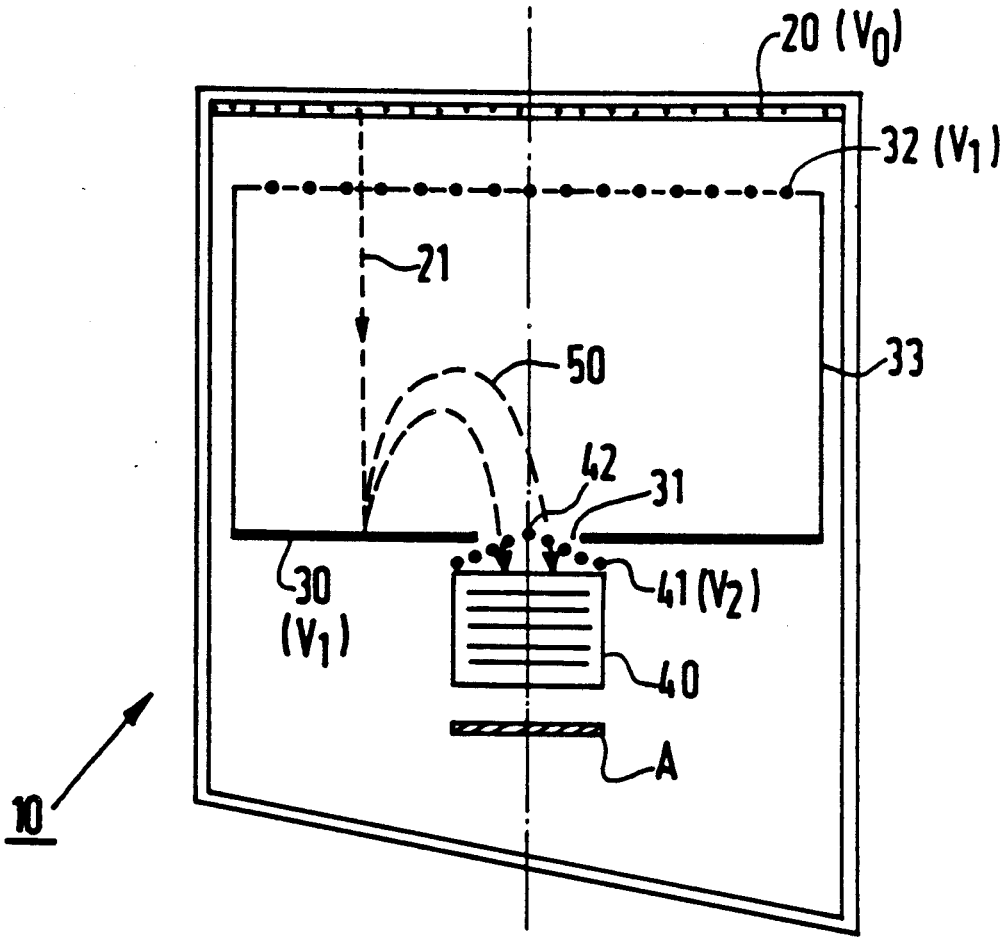
20 ($V_0$)
32 ($V_1$)
21
50
33
42
31
30
($V_1$)
41 ($V_2$)
40
A
10

PHOTOMULTIPLIER TUBE COMPRISING A LARGE FIRST DYNODE AND A STACKABLE-DYNODE MULTIPLIER

The present invention relates to a photomultiplier tube comprising a photocathode, a first dynode and a stackable-dynode electron multiplier device.

The invention is used with very great advantage in the field of photomultiplier tubes of the stackable-dynode electron multiplier device type. "Stackable-dynode electron multiplier device" must here be understood to mean multiplier devices having a laminar structure such as the multipliers of the "sheet" type (see, for example, French Patent No. 2 549 288) or also multipliers having dynodes of the Venetian blind ,type in which each dynode is formed by parallel strips which are inclined with respect to the axis of the multiplier.

A general technical problem which is encountered in every type of photomultiplier tubes is to have the disposal of a first dynode of large dimensions so as to ensure an adequate collection of the photoelectrons emitted by the photocathode. For the case of tubes having a stackable-dynode multiplier device, a further problem is added to the general technical problem in that the first dynode must be coupled to the multiplier device so that the secondary electrons emitted by the first dynode can reach the stackable-dynode electron multiplier device with only low losses. 25 A solution of this two-fold problem is given in, for example, French Patent No. 2 549 288, which discloses a photomultiplier tube of the type defined in the opening paragraph, whose first dynode is cylindrical and has generatrices which are at right angles to the tube axis. In this prior art tube, the coupling between the first dynode and the stackable-dynode electron multiplier device of the "sheet" type is realized by arranging the multiplier device at the output of the first dynode, the axis of the sheet-type multiplier being arranged perpendicularly to the tube axis. Thus, in this configuration, the multiplier device provides the largest capture area for the secondary electrons emitted by the first dynode, so that an appropriate collection efficiency is obtained.

The present state of the art photomultiplier tube has however the disadvantage that it is relatively bulky, mainly because of the fact that, taking account of the rather large dimensions of the first dynode and the dispersion of the secondary electrons emitted by this first dynode, the sheet-type multiplier device cannot be positioned in the direct vicinity of the first dynode. In addition, an outlet must be provided near the rear of the multiplier for the output connections.

The technical problem to be solved by the object of the present invention, is to provide a photomultiplier tube comprising a photocathode, a first dynode and a stackable-dynode electron multiplier device, with which it is possible to obtain a large first dynode whose coupling to the multiplier device will be less complicated thanks to an advantageous position of the stackable-dynode multiplier.

According to the invention, the technical problem posed is solved, in that said first dynode is constituted by a sheet extending substantially parallel to the photocathode, said sheet having a surface of a material emitting secondary electrons and being provided with a feedthrough aperture, an extracting grid which, during operation, is brought to an electric potential to attract photoelectrons emitted by the photocathode and being disposed between the photocathode and said sheet, and in that said stackable-dynode electron multiplier device is placed opposite said aperture in such a manner as to collect the secondary electrons emitted by the first dynode and passing through the feedthrough aperture.

Thus, on the one hand the surface of the first dynode is, but for the surface of the feedthrough aperture, of the same order as that of the photocathode. On the other hand, the feedthrough aperture being located, in general, in the centre of the sheet, in the tube axis, the stackable-dynode electron multiplier device whose axis then extends parallel to the tube axis, is in a central position in the tube, which results in a significant reduction in the bulk of the tube.

The photomultiplier tube according to the invention has the advantage that the secondary electrons emitted by the first dynode arrive directly at the stackable-dynode electron multiplier device without it being necessary to use, for example, intermediate dynodes which to some extent would act as deflectors deflecting the electron beam towards the stackable-dynode multiplier.

Finally, with the object of the largest possible collection on the multiplier device, it is provided that, the said stackable-dynode electron multiplier device having an input grid, said input grid has a shape with a raised relief in the region of and in the direction towards the feedthrough aperture. This advantageous arrangement renders it possible to raise the electric potential in the space situated between the extracting grid and the first dynode, and thus to attract secondary electrons towards the feedthrough aperture and the multiplier which secondary electrons, when the grid would not have a raised relief, would directly fall back on the sheet from which they were emitted without reaching the feedthrough aperture.

The following description which is given by way of non-limitative example with reference to the accompanying drawing, will make it better understood how the invention can be put into effect.

The sole figure is a cross-sectional view of a photomultiplier tube in accordance with the invention.

The figure shows, in a cross-sectional view, a photomultiplier tube 10 of the invention including a photocathode 20 which is deposited on a window sealed to the end of a cylindrical sleeve. In response to incident light rays, the photocathode 20 emits photoelectrons 21 which must travel to as far as a first dynode 30 at the end of the secondary multiplication operations. As is shown in FIG. 1, said first dynode 30 is constituted by a sheet which extends parallel to the photocathode 20, is coated with a material emitting secondary emission and is provided with a feedthrough aperture 31. The invention is however not limited to a first dynode made of metal. The first dynode may alternatively be partly provided with a nonconducting material or include an insulating support coated with an inductive layer. As the diameter of the feedthrough aperture 31 is rather small relative to the diameter of the sheet 30, the first dynode has a collecting surface close to the surface of the photocathode 20, which is quite large. By way of example, a photomultiplier tube has been realized whose first dynode has a diameter of 32 mm for a feedthrough aperture of 8 mm, i.e. a surface ratio of 16. On the other hand, the figure shows that an extracting grid 32 is arranged between the photocathode 20 and the metal sheet 30, a metallic cylinder 33 interconnects the sheet 30 and the extractor grid 32 which are consequently at the same potential V1. The photocathode 20 is brought to an electric potential $V_0$, chosen to be equal to 0V. The potential $V_1$ is, for example, 200 V. The photoelectrons 21 emitted by the photocathode 20 are thus attracted by the grid 32 and reach the first dynode 30 along a substantially rectilinear path, taking account of the fact that the electric potential between the grid 32 and the metallic sheet 30 varies relatively little. The grid 32 plays the part of a screen as regards the first dynode 30, which has for its effect that secondary electrons 50 emitted by the sheet 30 are prevented from falling directly back onto said sheet.

This configuration thus stimulates the attraction of secondary electrons 50 by the input stage of stackable-dynode electron multiplier device 40 placed opposite the aperture 31 in such a manner that it collects said secondary electrons emitted by the first dynode 30 and passing through the feedthrough aperture 31. The input stage of the multiplier device 40 is brought to a potential of, for example, 300V.

It should be noted that the photomultiplier tube 10 of the figure has a collection efficiency which is the greater when the photoelectrons which are supplied by the photocathode 20 and pass through the feedthrough aperture 31 directly without being multiplied by the first dynode 30 are nevertheless collected by the electron multiplier device 40 and thus participate in the current supplied by the anode A, even if their rate of contribution is low. However, the tube shown in FIG. 1 cannot be used as a fast tube.

The collection efficiency can be increased still further by having the lines of a higher electric potential penetrate further into the space comprised between the extracting grid 32 and the first dynode to ensure that the secondary electrons 50 produced at the periphery of the first dynode 30 are captured without fail. To that end, advantage is taken of the fact that the majority of stackable-dynode electron multiplier devices include an input grid to provide the advantageous arrangement which consists in that the said input grid is given a shape with a raised relief in the region of and in a direction towards the feedthrough aperture 31.

An example of a stackable-dynode electron multiplier device having an input grid which might satisfy the present invention is described in the French Patent No. 88 09 083.

I claim:

1. A photomultiplier tube (10) comprising a photocathode (20), a first dynode and a stackable-dynode electron multiplier device (40), characterized in that said first dynode (30) is constituted by a sheet extending substantially parallel to the photocathode (20), said sheet having a surface of a material emitting secondary electrons and being provided with a feedthrough aperture (31), an extracting grid (32) which, during operation, is brought to an electric potential to attract photoelectrons emitted by the photocathode (20) and being disposed between the photocathode (20) and said sheet, and in that said stackable-dynode electron multiplier device (40) is placed opposite said aperture (31) in such a manner as to collect the secondary electrons (50) emitted by the first dynode (30) and passing through the feedthrough aperture (31).

2. A photomultiplier tube as claimed in claim 1, characterized in that, the said stackable-dynode electron multiplier device (40) is provided with an input grid (41), said input grid (41) has a shape (42) with a raised relief in the region of and directed towards the feedthrough aperture (31).

* * * * *